US011619372B2

(12) United States Patent
McIntyre et al.

(10) Patent No.: US 11,619,372 B2
(45) Date of Patent: Apr. 4, 2023

(54) AREA LIGHT

(71) Applicant: MILWAUKEE ELECTRIC TOOL CORPORATION, Brookfield, WI (US)

(72) Inventors: Ross McIntyre, Wauwatosa, WI (US); Kyle Harvey, Wauwatosa, WI (US)

(73) Assignee: MILWAUKEE ELECTRIC TOOL CORPORATION, Brookfield, WI (US)

( * ) Notice: Subject to any disclaimer, the term of this patent is extended or adjusted under 35 U.S.C. 154(b) by 0 days.

(21) Appl. No.: 17/404,789

(22) Filed: Aug. 17, 2021

(65) Prior Publication Data

US 2021/0372604 A1 Dec. 2, 2021

Related U.S. Application Data

(63) Continuation of application No. 16/990,465, filed on Aug. 11, 2020, now Pat. No. 11,149,930, which is a
(Continued)

(51) Int. Cl.
*F21V 23/00* (2015.01)
*F21V 21/40* (2006.01)
(Continued)

(52) U.S. Cl.
CPC ..... *F21V 23/003* (2013.01); *F21S 9/02* (2013.01); *F21V 5/04* (2013.01); *F21V 21/406* (2013.01);
(Continued)

(58) Field of Classification Search
CPC ..... F21L 14/02; F21L 4/02; F21S 9/02; F21V 21/406; F21V 23/003; F21V 23/04;
(Continued)

(56) References Cited

U.S. PATENT DOCUMENTS 3,226,536 A 12/1965 Atkin et al.
3,331,958 A 7/1967 Adler
(Continued)

FOREIGN PATENT DOCUMENTS

EP 193756 A2 9/1986
EP 1205428 A1 5/2002
(Continued)

OTHER PUBLICATIONS

International Search Report and Written Opinion for Application No. PCT/US2017/018412 dated May 23, 2017 (13 pages).
(Continued)

*Primary Examiner* — Britt D Hanley
(74) *Attorney, Agent, or Firm* — Michael Best & Friedrich LLP

(57) ABSTRACT

An area light including a first end, a second end opposite the first end, a central axis extending between the first and second end, at least one handle that is mounted between the first and second end, a housing disposed adjacent to the first end, and a hook pivotably coupled to the housing and moveable between a stored position, in which the hook lies flat against the housing, and an active position, in which the hook extends away from the housing. The area light further includes a light assembly disposed between the housing and the second end, a battery receptacle that receives a battery along a path that is perpendicular to the central axis, and a diffuser surrounding the light assembly and coupled to the housing. The diffuser tapers circumferentially inward toward the central axis along a direction from the housing to the second end.

20 Claims, 8 Drawing Sheets

Related U.S. Application Data continuation of application No. 15/200,037, filed on Jul. 1, 2016, now Pat. No. 10,775,032.

(60) Provisional application No. 62/299,757, filed on Feb. 25, 2016, provisional application No. 62/187,539, filed on Jul. 1, 2015.

(51) Int. Cl.

| | |
|---|---|
| ***F21S 9/02*** | (2006.01) |
| ***H05B 45/00*** | (2022.01) |
| ***H05B 47/10*** | (2020.01) |
| ***F21V 5/04*** | (2006.01) |
| *F21L 4/02* | (2006.01) |
| *F21L 14/02* | (2006.01) |
| *F21Y 115/10* | (2016.01) |
| *F21W 131/10* | (2006.01) |
| *F21V 23/04* | (2006.01) |
| *F21V 29/74* | (2015.01) |

(52) U.S. Cl.
CPC ..... *H05B 45/00* (2020.01); *H05B 47/10* (2020.01); *F21L 4/02* (2013.01); *F21L 14/02* (2013.01); *F21V 23/04* (2013.01); *F21V 29/74* (2015.01); *F21W 2131/1005* (2013.01); *F21Y 2115/10* (2016.08)

(58) Field of Classification Search
CPC ... F21V 29/74; F21V 5/04; F21W 2131/1005; F21Y 2115/10; H05B 45/00; H05B 47/10
See application file for complete search history.

(56) References Cited

U.S. PATENT DOCUMENTS

| | | | | |
|---|---|---|---|---|
| 3,755,668 | A | 8/1973 | Moreschini | |
| 4,032,771 | A | 6/1977 | Ilzig | |
| 4,228,489 | A | 10/1980 | Martin | |
| 4,268,894 | A | 5/1981 | Bartunek et al. | |
| 4,324,477 | A | 4/1982 | Miyazaki | |
| 5,192,126 | A | 3/1993 | Remeyer | |
| 5,203,621 | A | 4/1993 | Weinmeister et al. | |
| 5,207,747 | A | 5/1993 | Gordin et al. | |
| 5,351,172 | A | 9/1994 | Attree et al. | |
| 5,400,234 | A | 3/1995 | Yu | |
| 5,428,520 | A | 6/1995 | Skief | |
| 5,630,660 | A | 5/1997 | Chen | |
| 5,860,729 | A * | 1/1999 | Bamber | F21S 6/002 362/399 |
| 5,934,628 | A | 8/1999 | Bosnakovic | |
| 5,964,524 | A | 10/1999 | Qian | |
| 6,045,240 | A | 4/2000 | Hochstein | |
| D428,176 | S | 7/2000 | Bamber et al. | |
| 6,092,911 | A | 7/2000 | Baker, III et al. | |
| 6,099,142 | A | 8/2000 | Liu | |
| 6,149,283 | A | 11/2000 | Conway et al. | |
| 6,183,114 | B1 | 2/2001 | Cook et al. | |
| 6,213,626 | B1 | 4/2001 | Qian | |
| 6,255,786 | B1 | 7/2001 | Yen | |
| 6,265,969 | B1 | 7/2001 | Shih | |
| D452,022 | S | 12/2001 | Osiecki et al. | |
| 6,367,949 | B1 | 4/2002 | Pederson | |
| 6,379,023 | B1 | 4/2002 | Passno | |
| 6,461,017 | B2 | 10/2002 | Selkee | |
| 6,474,844 | B1 | 11/2002 | Ching | |
| 6,554,459 | B2 | 4/2003 | Yu et al. | |
| 6,637,904 | B2 | 10/2003 | Hernandez | |
| 6,824,297 | B1 | 11/2004 | Lee | |
| 6,854,862 | B1 | 2/2005 | Hopf | |
| 6,857,756 | B2 | 2/2005 | Reiff et al. | |
| 6,873,249 | B2 | 3/2005 | Chu | |
| 6,877,881 | B2 | 4/2005 | Tsao | |
| 6,899,441 | B2 | 5/2005 | Chen | |
| D506,847 | S | 6/2005 | Hussaini et al. | |
| 6,902,294 | B2 | 6/2005 | Wright | |
| 6,926,428 | B1 | 8/2005 | Lee | |
| 7,001,044 | B2 | 2/2006 | Leen | |
| 7,001,047 | B2 | 2/2006 | Holder et al. | |
| 7,011,280 | B2 | 3/2006 | Murray et al. | |
| 7,063,444 | B2 | 6/2006 | Lee et al. | |
| 7,073,926 | B1 | 7/2006 | Kremers et al. | |
| D532,536 | S | 11/2006 | Krieger et al. | |
| 7,152,997 | B1 | 12/2006 | Kovacik et al. | |
| 7,153,004 | B2 | 12/2006 | Galli | |
| 7,194,358 | B2 | 3/2007 | Callaghan et al. | |
| 7,195,377 | B2 | 3/2007 | Tsai | |
| 7,224,271 | B2 | 5/2007 | Wang | |
| D553,281 | S | 10/2007 | Rugendyke et al. | |
| D553,771 | S | 10/2007 | Watson et al. | |
| 7,278,761 | B2 | 10/2007 | Kuan | |
| 7,350,940 | B2 | 4/2008 | Haugaared et al. | |
| 7,364,320 | B2 | 4/2008 | Van Deursen et al. | |
| 7,367,695 | B2 | 5/2008 | Shiau | |
| 7,470,036 | B2 | 12/2008 | Deighton et al. | |
| 7,484,858 | B2 | 2/2009 | Deighton | |
| 7,503,530 | B1 | 3/2009 | Brown | |
| 7,566,151 | B2 | 7/2009 | Whelan et al. | |
| 7,618,154 | B2 | 11/2009 | Rosiello | |
| 7,638,970 | B1 | 12/2009 | Gebhard et al. | |
| D612,965 | S | 3/2010 | Extrand | |
| 7,670,034 | B2 | 3/2010 | Zhang et al. | |
| D621,536 | S | 8/2010 | Lee | |
| D622,430 | S | 8/2010 | Chilton | |
| 7,798,684 | B2 | 9/2010 | Boissevain | |
| 7,828,465 | B2 | 11/2010 | Roberge et al. | |
| 7,857,486 | B2 | 12/2010 | Long et al. | |
| 7,914,178 | B2 | 3/2011 | Xiang et al. | |
| 7,914,182 | B2 | 3/2011 | Mrakovich et al. | |
| 7,972,036 | B1 | 7/2011 | Schach et al. | |
| D643,138 | S | 8/2011 | Kawase et al. | |
| 7,988,335 | B2 | 8/2011 | Liu et al. | |
| 7,990,062 | B2 | 8/2011 | Liu | |
| 7,997,753 | B2 | 8/2011 | Walesa | |
| 8,007,128 | B2 | 8/2011 | Wu et al. | |
| 8,007,145 | B2 | 8/2011 | Leen | |
| 8,029,169 | B2 | 10/2011 | Liu | |
| 8,047,481 | B2 | 11/2011 | Shen | |
| 8,087,797 | B2 | 1/2012 | Pelletier et al. | |
| 8,142,045 | B2 | 3/2012 | Peak | |
| 8,167,466 | B2 | 5/2012 | Liu | |
| D661,417 | S | 6/2012 | Kung | |
| 8,201,979 | B2 | 6/2012 | Deighton et al. | |
| D665,521 | S | 8/2012 | Werner et al. | |
| 8,235,552 | B1 | 8/2012 | Tsuge | |
| 8,262,248 | B2 | 9/2012 | Wessel | |
| 8,294,340 | B2 | 10/2012 | Yu et al. | |
| 8,322,892 | B2 | 12/2012 | Scordino et al. | |
| 8,328,398 | B2 | 12/2012 | Van Deursen | |
| 8,330,337 | B2 | 12/2012 | Yu et al. | |
| 8,360,607 | B2 | 1/2013 | Bretschneider et al. | |
| 8,366,290 | B2 | 2/2013 | Maglica | |
| 8,403,522 | B2 | 3/2013 | Chang | |
| 8,425,091 | B2 | 4/2013 | Chen | |
| 8,439,531 | B2 | 5/2013 | Trott et al. | |
| 8,465,178 | B2 | 6/2013 | Wilcox et al. | |
| 8,485,691 | B2 | 7/2013 | Hamel et al. | |
| D687,591 | S | 8/2013 | Chilton et al. | |
| 8,547,022 | B2 | 10/2013 | Summerford et al. | |
| D694,445 | S | 11/2013 | Shiu | |
| D695,434 | S | 12/2013 | Shen | |
| 8,599,097 | B2 | 12/2013 | Intravatola | |
| D698,471 | S | 1/2014 | Poon | |
| D699,874 | S | 2/2014 | Chilton et al. | |
| 8,651,438 | B2 | 2/2014 | Deighton et al. | |
| 8,659,433 | B2 | 2/2014 | Petrou | |
| 8,692,444 | B2 | 4/2014 | Patel et al. | |
| 8,696,177 | B1 | 4/2014 | Frost | |
| D705,467 | S | 5/2014 | Aglassinger | |
| D706,968 | S | 6/2014 | McDonough et al. | |
| D708,376 | S | 7/2014 | Crowe et al. | |
| 8,801,226 | B2 | 8/2014 | Moore | |
| 8,851,699 | B2 | 10/2014 | McMillan | |

(56) References Cited

U.S. PATENT DOCUMENTS

| | | | |
|---|---|---|---|
| 8,858,016 | B2 | 10/2014 | Strelchuk |
| 8,858,026 | B2 | 10/2014 | Lee et al. |
| 8,939,602 | B2 | 1/2015 | Wessel |
| 8,979,331 | B2 | 3/2015 | Lee et al. |
| D726,354 | S | 4/2015 | Davies |
| D728,402 | S | 5/2015 | Case |
| D729,428 | S | 5/2015 | Shen |
| 9,060,407 | B2 | 6/2015 | West |
| 9,068,736 | B2 | 6/2015 | Lee et al. |
| 9,182,088 | B2 | 11/2015 | Workman et al. |
| D747,263 | S | 1/2016 | Lafferty |
| 9,713,216 | B2 | 7/2017 | Urry et al. |
| D794,235 | S | 8/2017 | Green |
| 9,851,088 | B2 | 12/2017 | Kyle et al. |
| D809,687 | S | 2/2018 | Krantz et al. |
| D822,246 | S | 7/2018 | Hou |
| D828,939 | S | 9/2018 | Bo |
| D844,875 | S | 4/2019 | Jeon |
| D911,565 | S | 2/2021 | Bertken |
| D914,937 | S | 3/2021 | Liu |
| 2002/0136005 | A1 | 9/2002 | Lee |
| 2002/0167814 | A1 | 11/2002 | Ching |
| 2002/0191396 | A1 | 12/2002 | Reiff et al. |
| 2003/0090904 | A1 | 5/2003 | Ching |
| 2003/0137847 | A1 | 7/2003 | Cooper |
| 2003/0174503 | A1 | 9/2003 | Yueh |
| 2005/0265035 | A1 | 12/2005 | Brass et al. |
| 2006/0007682 | A1 | 1/2006 | Reiff, Jr. et al. |
| 2006/0067077 | A1 | 3/2006 | Kumthampinij et al. |
| 2006/0146550 | A1 | 7/2006 | Simpson et al. |
| 2006/0203478 | A1 | 9/2006 | Waters |
| 2006/0279948 | A1 | 12/2006 | Tsai |
| 2006/0285323 | A1 | 12/2006 | Fowler |
| 2007/0211470 | A1 | 9/2007 | Huang |
| 2007/0297167 | A1 | 12/2007 | Greenhoe |
| 2008/0036584 | A1 | 2/2008 | Lang et al. |
| 2008/0112170 | A1 | 5/2008 | Trott et al. |
| 2008/0158887 | A1 | 7/2008 | Zhu et al. |
| 2008/0165537 | A1 | 7/2008 | Shiau |
| 2008/0198588 | A1 | 8/2008 | O'Hern |
| 2008/0253125 | A1 | 10/2008 | Kang et al. |
| 2008/0302933 | A1 | 12/2008 | Cardellini |
| 2009/0080205 | A1 | 3/2009 | Chang et al. |
| 2009/0134191 | A1 | 5/2009 | Phillips |
| 2009/0135594 | A1 | 5/2009 | Yu et al. |
| 2009/0303717 | A1 | 12/2009 | Long et al. |
| 2010/0027260 | A1 | 2/2010 | Liu |
| 2010/0027269 | A1 | 2/2010 | Lo et al. |
| 2010/0072897 | A1 | 3/2010 | Zheng |
| 2010/0080005 | A1 | 4/2010 | Gattari |
| 2010/0091495 | A1 | 4/2010 | Patrick |
| 2010/0142213 | A1 | 6/2010 | Bigge et al. |
| 2010/0315824 | A1 | 12/2010 | Chen |
| 2010/0328951 | A1 | 12/2010 | Boissevain |
| 2011/0031887 | A1 | 2/2011 | Stoll et al. |
| 2011/0038144 | A1 | 2/2011 | Chang |
| 2011/0050070 | A1 | 3/2011 | Pickard |
| 2011/0058367 | A1 | 3/2011 | Shiau et al. |
| 2011/0075404 | A1 | 3/2011 | Allen et al. |
| 2011/0089838 | A1 | 4/2011 | Pickard et al. |
| 2011/0121727 | A1 | 5/2011 | Sharrah et al. |
| 2011/0156584 | A1 | 6/2011 | Kim |
| 2011/0228524 | A1 | 9/2011 | Greer |
| 2011/0286216 | A1 | 11/2011 | Araman |
| 2011/0317420 | A1 | 12/2011 | Jeon et al. |
| 2012/0026729 | A1 | 2/2012 | Sanchez et al. |
| 2012/0033400 | A1 | 2/2012 | Remus et al. |
| 2012/0033429 | A1 | 2/2012 | Van De Ven |
| 2012/0044707 | A1 | 2/2012 | Breidenassel |
| 2012/0048511 | A1 | 3/2012 | Moshtagh |
| 2012/0049717 | A1 | 3/2012 | Lu |
| 2012/0057351 | A1 | 3/2012 | Wilcox et al. |
| 2012/0087118 | A1 | 4/2012 | Bailey et al. |
| 2012/0087125 | A1 | 4/2012 | Liu |
| 2012/0098437 | A1 | 4/2012 | Smed |
| 2012/0120674 | A1 | 5/2012 | Jonker |
| 2012/0140455 | A1 | 6/2012 | Chang et al. |
| 2012/0155104 | A1 | 6/2012 | Jonker |
| 2012/0212963 | A1 | 8/2012 | Jigamain |
| 2012/0234519 | A1 | 9/2012 | Lee |
| 2012/0236551 | A1 | 9/2012 | Sharrah et al. |
| 2012/0247735 | A1 | 10/2012 | Ito et al. |
| 2012/0262917 | A1 | 10/2012 | Courcelle |
| 2012/0300487 | A1 | 11/2012 | Jonker |
| 2013/0032323 | A1 | 2/2013 | Hsu |
| 2013/0058078 | A1 | 3/2013 | Meng |
| 2013/0077296 | A1* | 3/2013 | Goeckel ..... F21V 7/00 362/217.05 |
| 2013/0128565 | A1 | 5/2013 | Cugini et al. |
| 2013/0176713 | A1 | 7/2013 | Deighton et al. |
| 2013/0187785 | A1 | 7/2013 | McIntosh et al. |
| 2013/0258645 | A1 | 10/2013 | Weber et al. |
| 2013/0265780 | A1 | 10/2013 | Choski et al. |
| 2013/0322073 | A1 | 12/2013 | Hamm et al. |
| 2014/0140050 | A1 | 5/2014 | Wong et al. |
| 2014/0192543 | A1 | 7/2014 | Deighton et al. |
| 2014/0218936 | A1 | 8/2014 | Mahling et al. |
| 2014/0268775 | A1 | 9/2014 | Kennemer et al. |
| 2014/0301066 | A1 | 10/2014 | Inskeep |
| 2014/0307443 | A1 | 10/2014 | Clifford et al. |
| 2014/0376216 | A1 | 12/2014 | McLoughlin et al. |
| 2015/0023771 | A1 | 1/2015 | Carr et al. |
| 2015/0233569 | A1 | 8/2015 | Xue et al. |
| 2015/0233571 | A1 | 8/2015 | Inan et al. |
| 2015/0267882 | A1 | 9/2015 | O'Brien |
| 2015/0267902 | A1* | 9/2015 | Zhang ..... F21V 21/30 362/188 |
| 2016/0348879 | A1 | 12/2016 | Young et al. |
| 2016/0360585 | A1 | 12/2016 | Urry et al. |
| 2017/0280528 | A1 | 9/2017 | Urry et al. |
| 2020/0370739 | A1 | 11/2020 | McIntyre et al. |
| 2021/0041087 | A1* | 2/2021 | Young ..... F21L 4/00 |

FOREIGN PATENT DOCUMENTS

| | | | |
|---|---|---|---|
| EP | 2436641 | A1 | 4/2012 |
| GB | 2424694 | A | 10/2006 |
| KR | 20100089371 | A | 8/2010 |
| KR | 20100116933 | A | 11/2010 |
| WO | 2002044503 | A1 | 6/2002 |
| WO | 2011073828 | A1 | 6/2011 |
| WO | 2011112005 | A2 | 9/2011 |
| WO | 2014083117 | A1 | 6/2014 |
| WO | 2014207595 | A1 | 12/2014 |

OTHER PUBLICATIONS

European Patent Office Partial Supplementary Search Report for Application No. 17757035.5 dated Sep. 19, 2019 (14 pages).
European Patent Office Extended Search Report for Application No. 17757035.5 dated Jan. 3, 2020 (11 pages).
European Patent Office Action for Application No. 17757035.5 dated Mar. 21, 2022 (6 pages).

* cited by examiner

AREA LIGHT

CROSS-REFERENCE TO RELATED APPLICATIONS

This application is a continuation of U.S. Non-Provisional application Ser. No. 16/990,465, filed Aug. 11, 2020, now U.S. Pat. No. 11,149,930, which is a continuation of U.S. Non-Provisional application Ser. No. 15/200,037, filed Jul. 1, 2016, now U.S. Pat. No. 10,775,032, which claims priority to U.S. Provisional Application No. 62/299,757, filed Feb. 25, 2016, and U.S. Provisional Application No. 62/187,539, filed Jul. 1, 2015, the entire contents of which are incorporated herein by reference.

BACKGROUND

The present invention relates lighting devices, and more particularly to portable workspace lighting devices.

SUMMARY

The present invention provides, in one aspect, an area light including a power inlet connectable to a power source, a housing supporting a light assembly, and a user interface including control members configured to operate the light assembly between multiple modes of operation.

In accordance with some constructions, the power source is a battery, the light assembly is an array of LEDs, and the user interface includes a first control member for turning the light assembly on and off and a second control member for operating the light between two or more intensity levels.

In accordance with some constructions, the battery is a 5 amp/hour battery and is capable of providing power to the array of LEDs to produce between 5700 lumens and 7700 lumens for 1 to 3 hours. More specifically, the battery is configured to provide power to the array of LEDs to produce 6700 lumens for about 2 hours.

In accordance with some constructions, the light assembly is an array of 80 to 280 LEDs. More specifically, the light assembly is an array of 180 LEDs. This array of LEDs may be configured to emit light at approximately 3700-4300 Kelvin with a color rendering index (CRI) between about 50 and 100. More specifically, the light that is emitted by the LEDs is about 4000 Kelvin with a CRI of about 70.

In accordance with some constructions, the housing includes a lens surrounding the light assembly. The lens is configured to withstand a two meter drop test. The lens may be removably coupled to the housing. When the lens is coupled to the housing and surrounds the light assembly, approximately 3500-5500 lumens passes through the lens. More specifically, approximately 4500 lumens will pass through the lens.

In one construction, an area light includes a housing defining a central axis and including a first portion and a second portion, the second portion arranged to emit light. A lens is coupled to the housing, and a light assembly is disposed within the second portion. The light assembly includes a plurality of LEDs arranged to emit light through the lens and in a direction that extends 360 degrees around the central axis. A battery is selectively coupled to the housing and is arranged to provide power to the LEDs to allow for the emission of light at a level of at least 5700 lumens for at least two hours.

In another construction, an area light includes a housing defining a central axis and including a first portion and a second portion, a lens coupled to the housing and disposed substantially within the second portion, and a light assembly arranged to emit light from each of a plurality of sectors arranged around the central axis, the plurality of sectors cooperating to completely surround the central axis. A plurality of LEDs is arranged in each of the plurality of sectors, and a control unit is operable to control the distribution of electrical power to the plurality of LEDs, and to selectively direct power to all of the plurality of sectors or to a subset of the plurality of sectors.

In yet another construction, an area light includes a housing defining a central axis and a light assembly defining a plurality of sectors that extend 360 degrees around the central axis, each of the plurality of sectors including a plurality of LEDs arranged to emit light in a direction substantially normal to the central axis. A planar sector is arranged normal to the central axis and includes a plurality of top LEDs arranged to emit light in a direction substantially parallel to the central axis. A lens is coupled to the housing and covers the light assembly and the planar sector, a port is formed as part of the housing and sized to selectively receive a battery, and a power inlet is arranged to selectively receive electrical power from an AC source of power. A control unit is operable to control the distribution of electrical power from one of the port and the power inlet to the plurality of LEDs, and is operable to selectively direct power to all of the plurality of sectors or to a subset of the plurality of sectors.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

FIGS. 1-6 illustrate an area light 10 configured to provide illumination to a workspace. The area light 10 may be held by a user or hung on a support member using features discussed in greater detail below. In addition, the area light 10 may be controlled via a user interface 14 to operate in a plurality of lighting modes.

Figure 1:
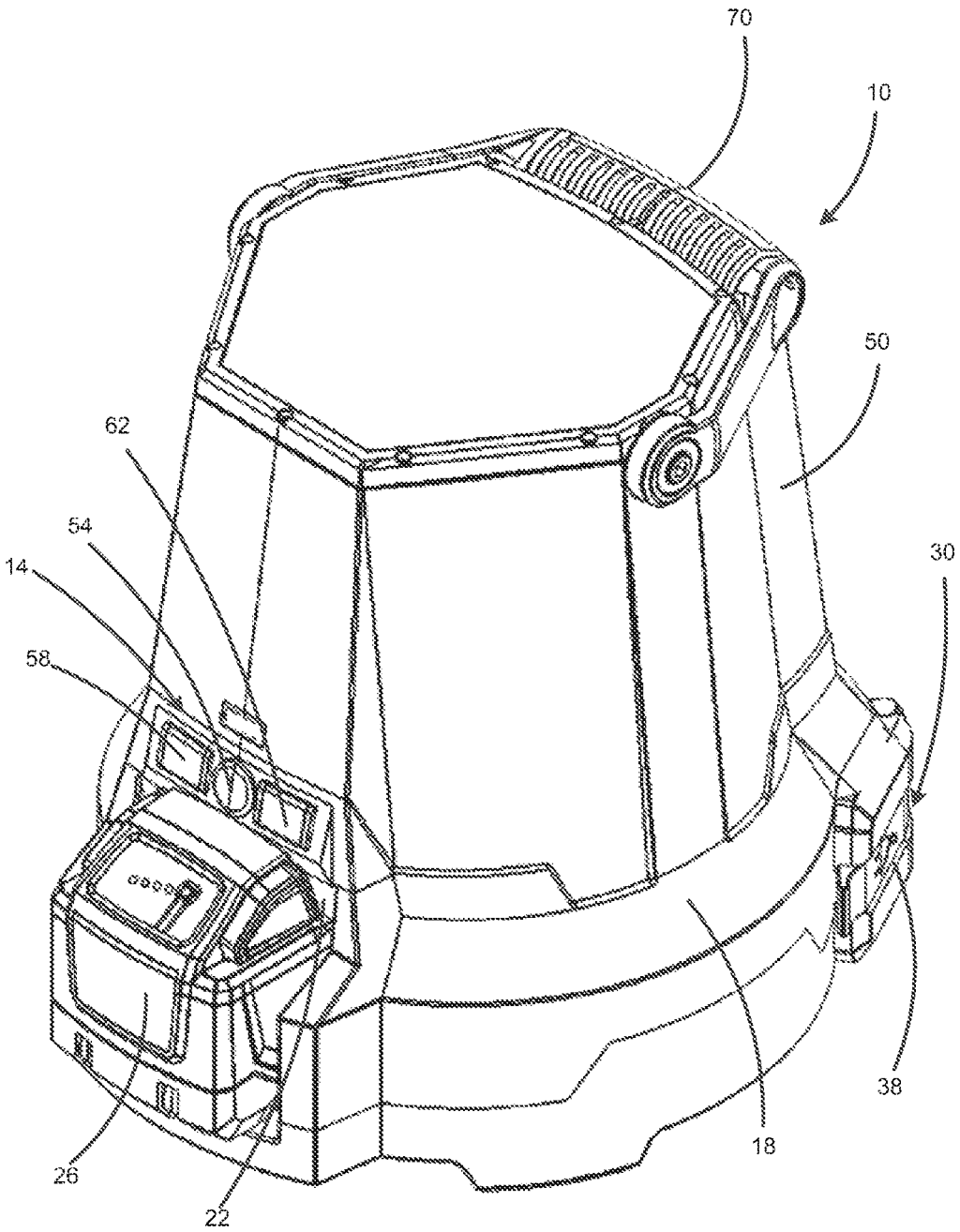
FIG. 1 is a front perspective view of an area light.
Figure 2:
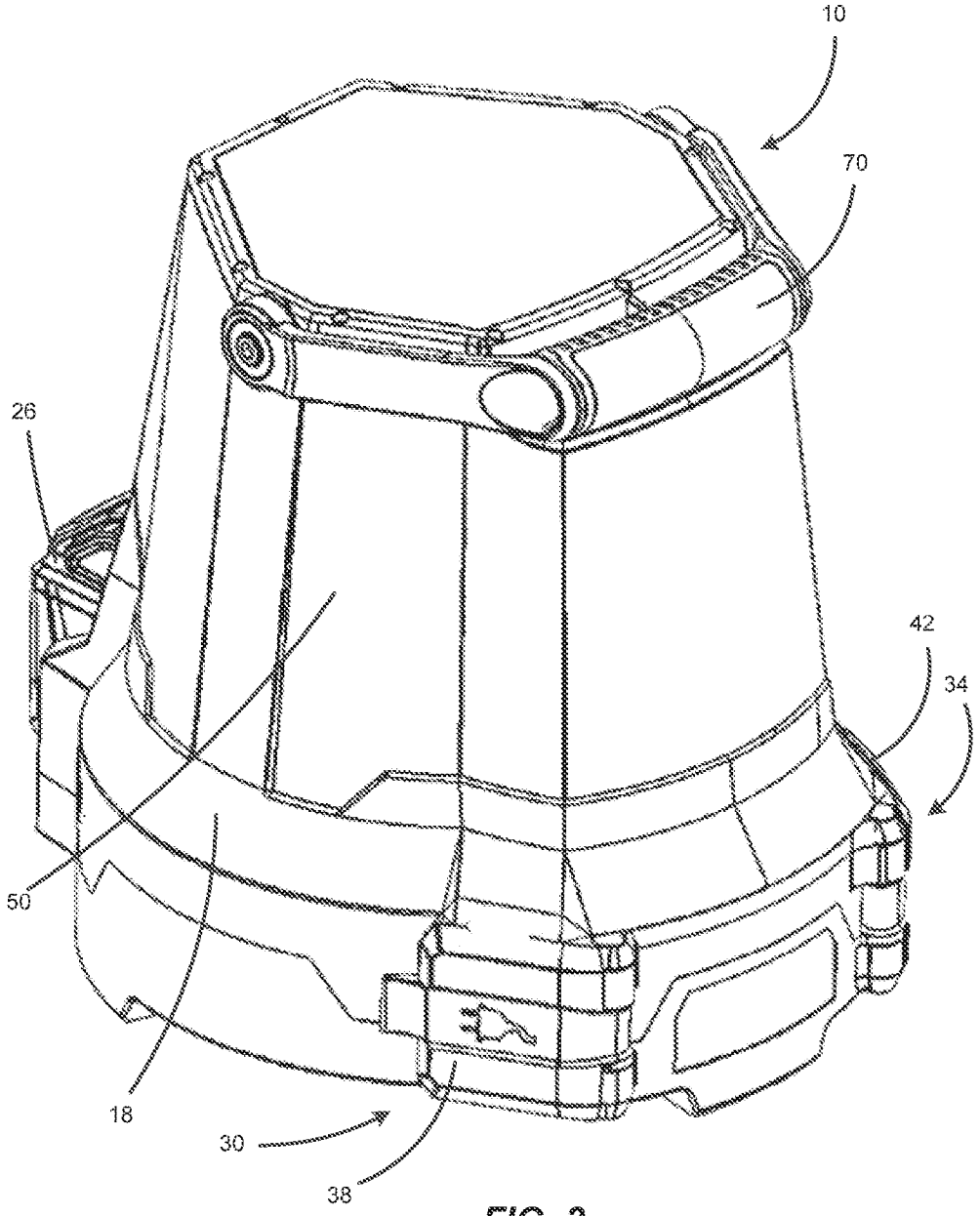
FIG. 2 is a first side, rear perspective view of the area light.
Figure 3:
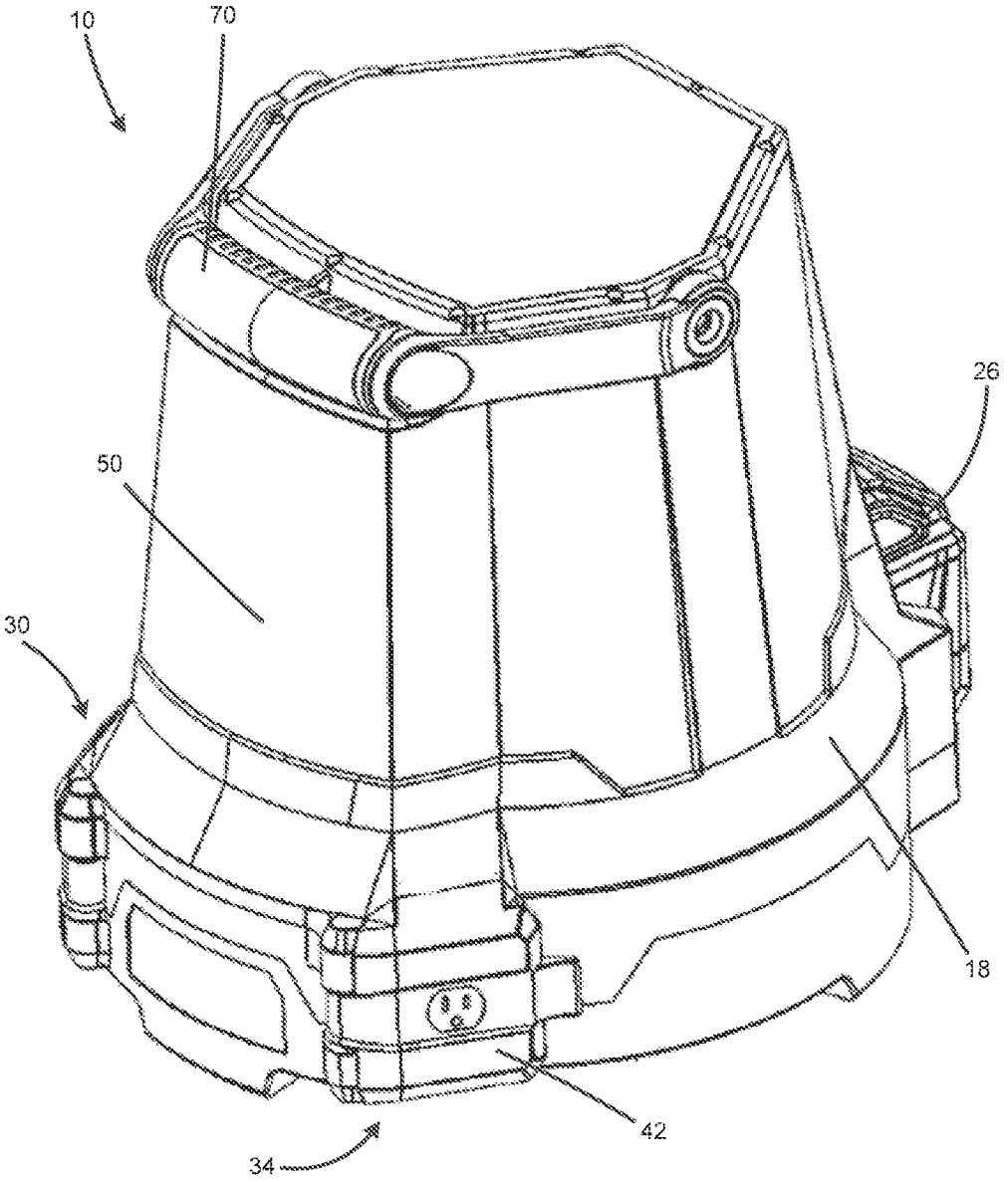
FIG. 3 is a second side, rear perspective view of the area light.

With reference to FIG. 1-3, the area light 10 includes a housing 18 with a port 22 configured to detachably support a battery 26 at one end. The housing 18 also includes a power inlet 30 (e.g., AC power inlet, etc.) and a power outlet 34 (e.g., standard three pin adapter, any standard outlet used in countries around the world, etc.) spaced from the port 22 and configured to, among other things, allow for multiple lights 10 to be connected to the same power source via connections with other lights 10. Put simply, multiple lights 10 may be 'daisy-chained' together. In the illustrated construction, the power inlet 30 and the power outlet 34 are selectively covered by pivoting doors 38, 42 such that the inlet 30 and the outlet 34 may be covered and protected when they are not in use.

The battery 26 and/or an external power source are configured to supply power to a light assembly 46 via the port 22 and the power inlet 30, respectively. In preferred constructions, the battery 26 is a power tool battery pack that can be inserted into the port 22 and removed from the port 22 without any disassembly of the light 10. In one construction, the light assembly 46 includes an array of LEDs. For example, the light assembly 46 may be an array of about 80-280 LEDs. More specifically, the light assembly 46 may be an array of 180 LEDs. In a specific example, the array of LEDs is configured to generate approximately 5700-7700 lumens for about two hours when powered by a 5 amp/hour battery. Further, the light that is emitted by the LEDs is approximately 3700-4300 Kelvin with a color rendering index (CRI) between about 50 and 100. More specifically, the light that is emitted is about 4000 Kelvin with a CRI of about 70.

With reference to FIGS. 1-4, the housing 18 is also configured to support a lens 50 that surrounds the light assembly 46. In some constructions, the lens 50 may be detachably coupled to the housing 18. For example, the lens 50 may be coupled to the housing 18 using a set of fasteners, a ball detent, an interference fit, or other suitable mechanisms.

In some constructions, the lens 50 is be configured to withstand a two meter drop test without any adverse functional effects. This may be accomplished by having a certain lens thickness or by constructing the lens 50 from various materials. In addition, the lens 50 is also configured to have specific light transmission properties—that is, the lens 50 may be configured to transmit a certain percentage, color, or other light characteristic from the light assembly 46 to the surrounding workspace. In a specific example, the lens 50 is configured to transmit approximately 3500-5500 lumens from the light assembly to the work space. More specifically, the lens 50 is configured to transmit 4500 lumens from the light assembly 46 to the work space. The lens also shifts the color temperature of the light by about 200 Kelvin such that the light exiting the lens has a color temperature between about 3500 Kelvin and 4100 Kelvin.

Figure 4:
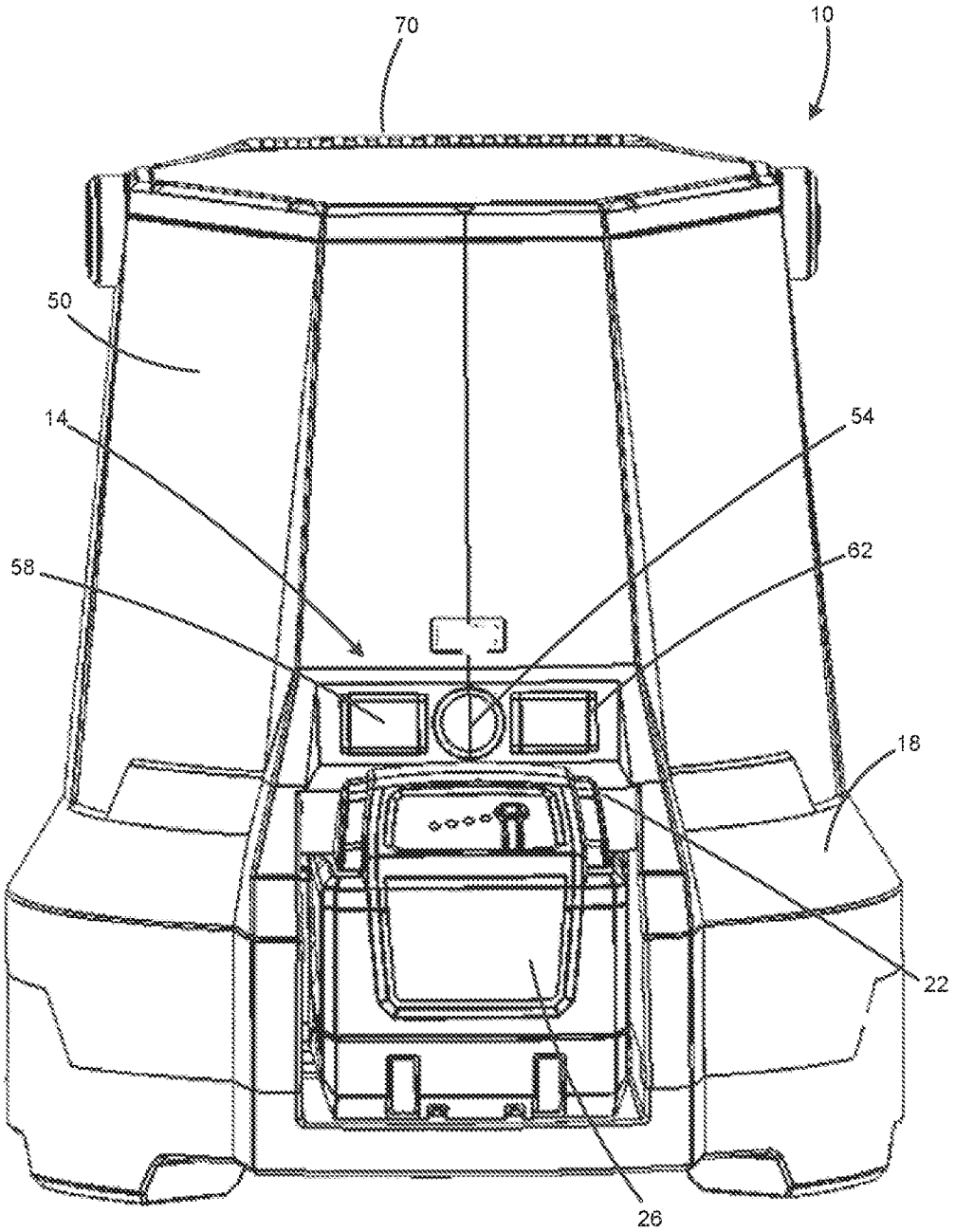
FIG. 4 is a front view of the area light.

With reference to FIGS. 1 and 4, the area light 10 includes the user interface 14 disposed on the housing 18. In the illustrated construction, the user interface 14 includes a first control member 54, a second control member 58, and a third control member 62. The first control member 54 may be a button, switch, or any suitable control mechanism that is configured to toggle the light assembly 46 between an energized state (i.e., on) and a de-energized state (i.e., off). The second control member 58 may also be a button, switch or any suitable control mechanism that is configured to toggle sections of the light assembly 46 on and off. Accordingly, the light assembly 46 may be operated such that only portions of the light assembly 46 are energized. For example, one half (divided along any axis) of the light assembly 46 may be energized while the other half is de-energized, and vice versa. The third control member 62 also may be a button, switch or any suitable control mechanism that is configured to control the intensity of light emitted by the light assembly 46. For example, the third control member 62 may operate the light between a high intensity, medium intensity, and low intensity. Other intermediate intensities may be included as well. In the specific example of the LED light assembly described above, the light intensity control is accomplished using pulse width modulation, although other alternative methods known in the art may be used. While three separate control members are illustrated and described, other constructions may combine some of the functions described into fewer than three control members or may include additional control members that allow for different operating functions.

The area light 10 also includes an internal control unit 66, such as a microcontroller or memory unit storing information and executable functions. The internal control unit 66 is configured to store the state of the light as set by the second and third control members 58, 62 when the light assembly 46 is powered on and off by the first control member 54. This results in a light 10 that may be turned on and off while maintaining the most recent state of the light (e.g., the section of the light turned on and the intensity level), thereby allowing the user to turn the light on with the last settings without having to adjust the light.

Figure 5:
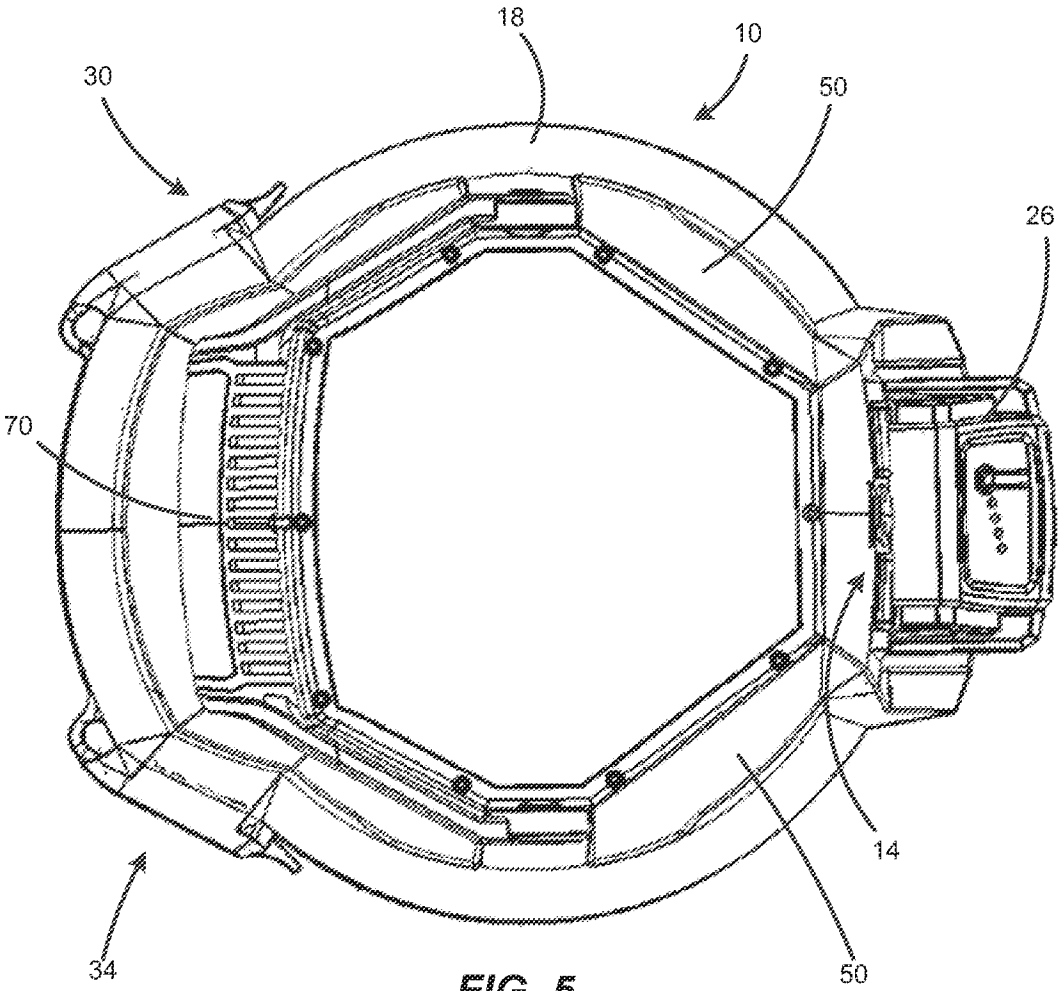
FIG. 5 is a top view of the area light.

With reference to FIG. 5, the area light 10 includes a pivotable handle 70 having a portion configured to be grasped by a user. Alternatively, the handle 70 may also be configured to be hung on a support member within a workspace (e.g., a hook, a rod, etc.) to hang the light above the ground. The handle 70 is shown in a stowed position and is pivotable to a carrying position in which a user can carry the light 10 or hang the light 10 on a support member.

Figure 6:
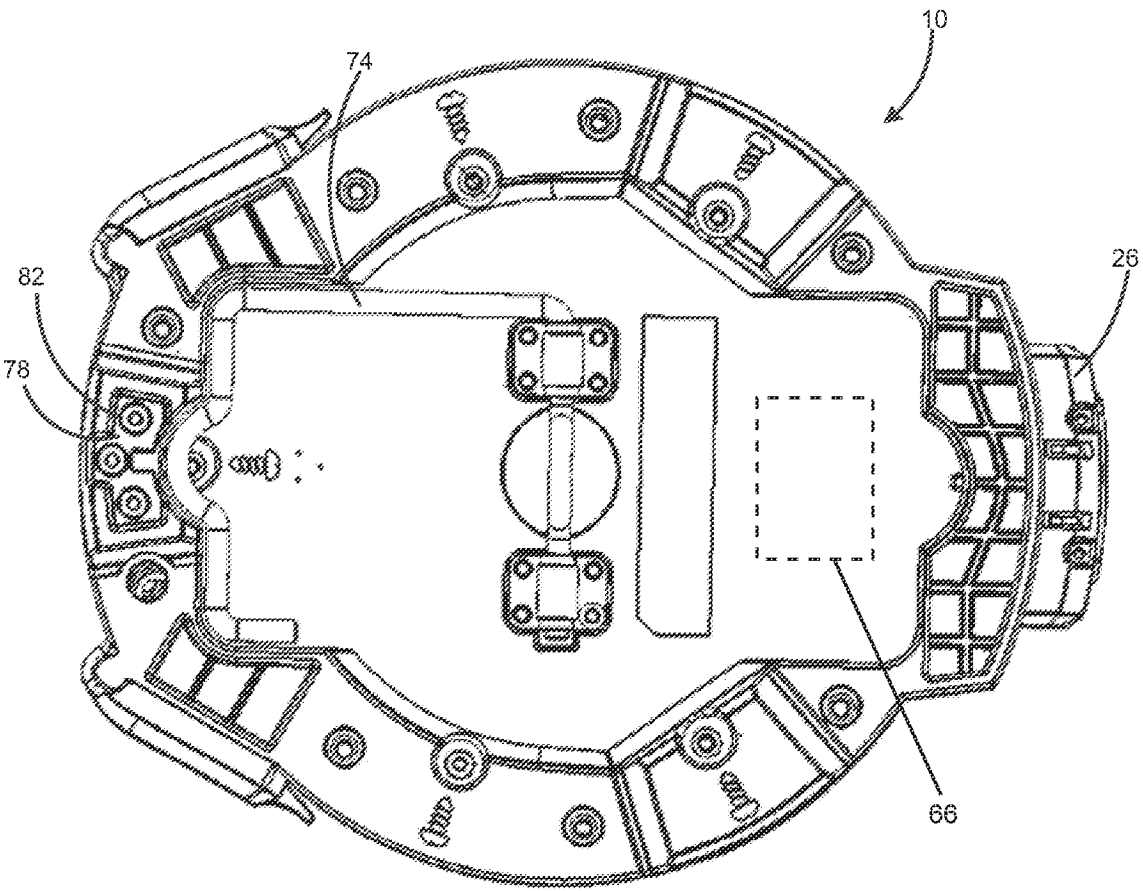
FIG. 6 is a bottom view of the area light.

With reference to FIG. 6, the area light 10 includes a pivotable hook 74 and a reinforced support plate 78 within a slot 82. The pivotable hook 74 defines an open end 76 such that the hook 74 may be pivoted relative to the light 10 in order to facilitate the hanging of the light 10 on a support member within the work space. The slot 82 is configured to receive a support member, such as a fastener head or hook, with the support member abutting the support plate 78. In this manner, the light 10 may be hung within on the support member within the work space.

In operation, the handle 70, the pivotable hook 74, and the slot 82 allow a user to couple the area light 10 to a support member in the work space. Using the user interface 14, the user may energize the light assembly 46 using the first control member 54 and adjust other light assembly characteristics using the second and third control members 58, 62. For example, the user may operate the light assembly at a desired intensity while also energizing only a portion of the light.

The light may also include a power control circuit that allows the light to select the power source from which, or to which power is delivered. For example, the power control circuit could be arranged to deliver power to the LEDs from the external power source when that power source is available and to automatically switch to or select the battery as the source when the external source is not available. In addition, the battery could be charged by the external power source while the external power source delivers power to the LEDs.

Figure 7:
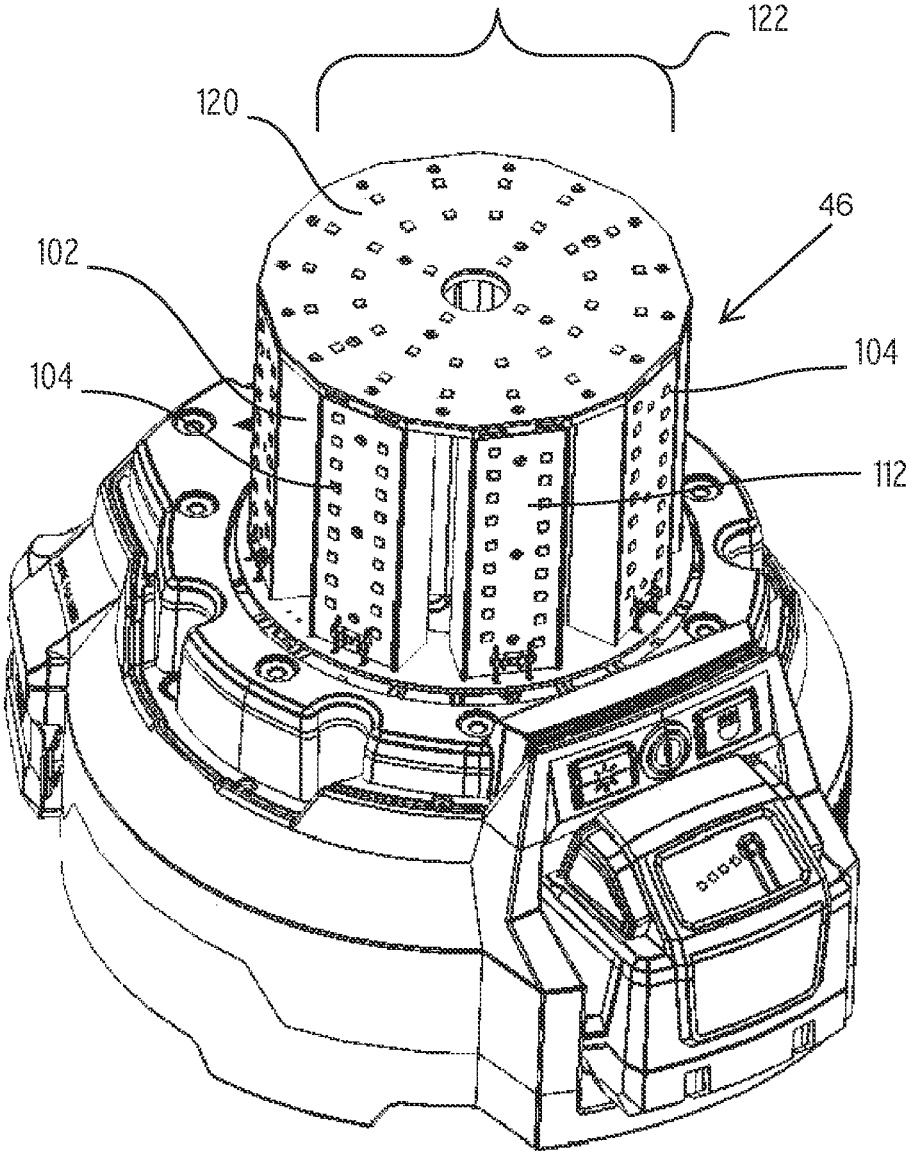
FIG. 7 is a perspective view of the area light of FIG. 1 with the lens removed.
Figure 8:
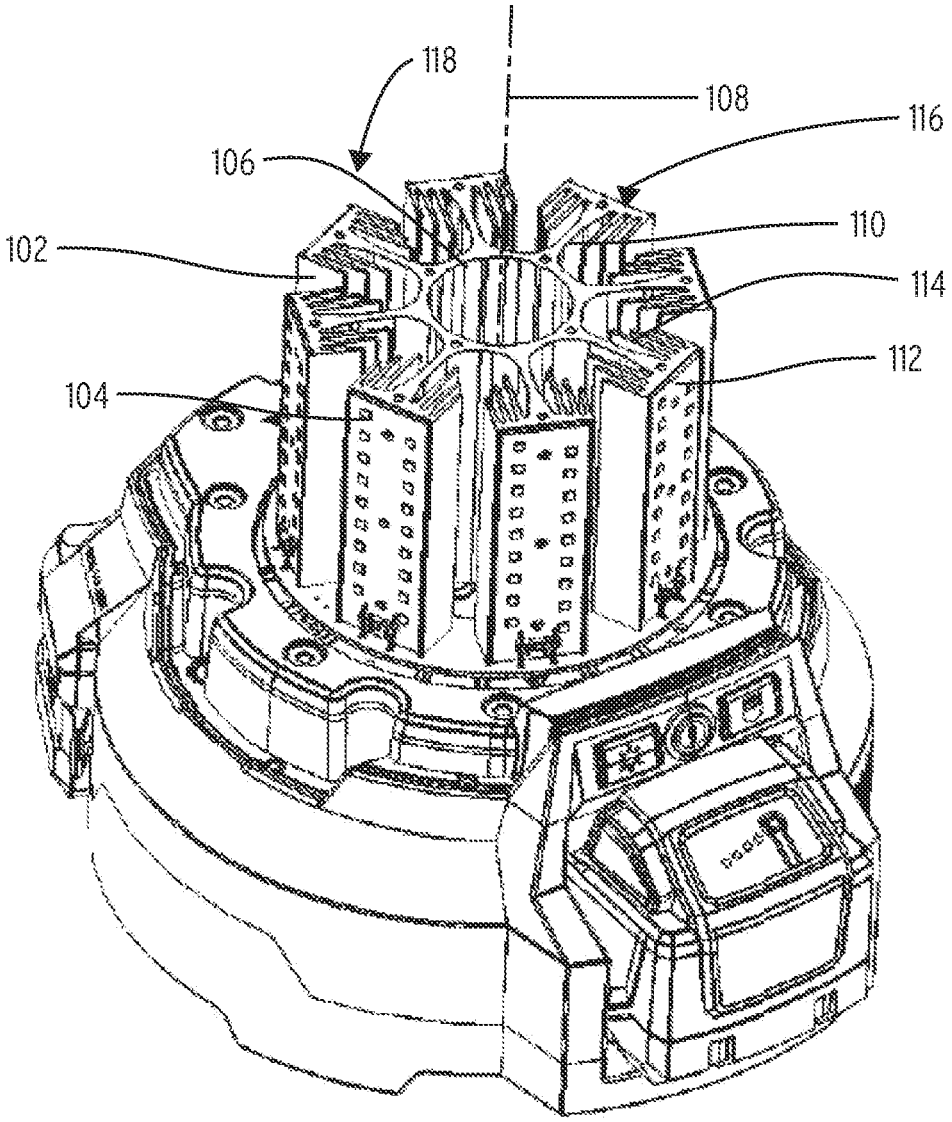
FIG. 8 is a perspective view of the area light of FIG. 7 with a portion of the light assembly and the lens removed.

FIGS. 7 and 8 show the area light of FIGS. 1-6 with the lens 50 removed to better illustrate features of the light assembly 46. With reference to FIG. 8, the light assembly 46 includes a heat sink 102 that supports a quantity of LEDs 104. The heat sink 102 includes a central tube portion 106 that extends along a central axis 108 and eight arms 110 extending radially outward from the central tube 106. Each of the arms 110 includes an outward facing surface 112 on which a number of LEDs 104 are attached. A number of fins 114 extend inward toward the central tube 106 from the outward facing surface 112 to enhance the cooling ability of the heat sink 102. Each of the arms 110 (or groups of arms 110) defines a sector 116, with the sectors 116 extending 360 degrees around the central axis 108 or the central tube 106. The user interface 14, first control member 54, second control member 58, third control member 62, or control unit are operable to activate the LEDs 104 on a per sector basis. Thus, in use, a user could activate the LEDs 104 on a single sector 116 or multiple sectors 116 as may be desired. In one construction, two adjacent arms 110 define a sector 118 such that the user can activate the light to illuminate a 90 degree wedge, a 180 degree wedge, a 270 degree wedge, or the entire 360 degree area around the light 10. The control unit is capable of storing the on/off configuration of the various sectors 116, 118 when the light 10 is turned off to allow the same sector on/off configuration when the light 10 is reactivated.

As illustrated in FIG. 7, a plate 120 is positioned on top of the heat sink 102 and includes a number of LEDs 104 arranged to direct light in a direction parallel to the central axis 108. The plate 120 and LEDs 104 define a planar sector 122 that can be controlled as a separate sector 122 as discussed with regard to FIG. 8 or can be grouped with another sector 116, 118 of the light 10.

Although the invention has been described in detail with reference to certain preferred embodiments, variations and modifications exist within the scope and spirit of one or more independent aspects of the invention as described.

What is claimed is:

1. An area light comprising:

a first end that is configured to be supported on a surface;

a second end that is opposite the first end, wherein light is emitted through the second end;

a central axis extending between the first end and the second end;

at least one handle that is mounted between the first end and the second end, wherein the at least one handle is graspable by a user to maneuver the area light;

a housing disposed adjacent to the first end and disposed circumferentially around the central axis, wherein at least a portion of the housing extends toward the second end along a direction parallel to the central axis;

a hook pivotably coupled to the housing adjacent the first end and moveable between a stored position, in which the hook lies flat against the housing, and an active position, in which the hook extends away from the housing;

a light assembly coupled to the housing and disposed between the housing and the second end;

a battery for supplying power to the light assembly;

a battery receptacle that receives the battery along a path that is perpendicular to the central axis, the battery receptacle disposed adjacent the first end, such that the battery receptacle is closer to the first end than the second end; and a diffuser surrounding the light assembly and coupled to the housing, the diffuser tapers circumferentially inward toward the central axis along a direction from the housing to the second end, wherein the diffuser diffuses light being emitted from the light assembly:

(i) through the second end along a direction substantially parallel to the central axis, and (ii) 360 degrees radially outward relative to the central axis along a length of the central axis between the housing and the second end.

2. The light of claim 1, wherein the at least one handle is pivotable about an axis perpendicular to the central axis.

3. The light of claim 1, wherein the hook is a monolithic component including a pivotable end that is pivotably attached to the housing and an open end that is capable of receiving a supporting element to hang the light above the surface when the hook is in the active position.

4. The light of claim 1, further comprising a slot defining a recess in the housing, wherein the recess of the slot is capable of receiving a supporting element to support the light on the supporting element when the hook is in the stowed position.

5. The light of claim 1, wherein the light assembly includes a heat sink that supports at least one light emitting diode.

6. The light of claim 5, wherein the heat sink includes a core portion that extends along the central axis and a plurality of arms extending radially outward from the core portion.

7. The light of claim 6, wherein each of the plurality of arms define a sector, wherein the sectors extend 360 degrees around the central axis.

8. The light of claim 6, wherein the plurality of arms each include fins that increase a surface area of the plurality of arms to enhance the cooling ability of the heat sink.

9. The light of claim 6, wherein the at least one light emitting diode is part of a plurality of light emitting diodes that are coupled to the plurality of arms.

10. The light of claim 7, further comprising a control unit disposed within the housing and a user interface in electrical communication with the control unit, wherein the user interface sends signals to the control unit to control the light assembly.

11. The light of claim 10, wherein the control unit is capable of activating the plurality of light emitting diodes within a sector on a per sector basis in response to the signals from the user interface.

12. An area light comprising:

a first end;

a second end that is opposite the first end, wherein light is emitted through the second end;

a central axis extending between the first end and the second end;

at least one handle that is mounted between the first end and the second end, wherein the at least one handle is graspable by a user;

a housing that extends from the first end toward the second end along the central axis;

a hook including a length and a pivot axis that is oriented perpendicular to the length, the hook being coupled to the housing adjacent the first end and pivotable about the pivot axis between a stored position, in which the hook lies flat against the housing and the length is oriented perpendicular to the central axis, and an active position, in which the hook extends away from the housing, wherein the hook pivots about the pivot axis when moving from the stored position;

a light assembly coupled to the housing and disposed between the housing and the second end, wherein the light assembly includes a heat sink and at least one light emitting diode supported by the heat sink; and a diffuser surrounding the light assembly and coupled to the housing, the diffuser tapers circumferentially inward toward the central axis along a direction from the housing to the second end, wherein the diffuser diffuses light being emitted from the light assembly:

(i) through the second end along a direction substantially parallel to the central axis, and (ii) 360 degrees radially outward relative to the central axis along a length of the central axis between the housing and the second end.

13. The light of claim 12, wherein the at least one handle is pivotable about an axis perpendicular to the central axis.

14. The light of claim 12, wherein the hook includes a pivotable end that is pivotably attached to the housing and an open end that is capable of receiving a supporting element to hang the light above a ground surface when the hook is in the active position.

15. The light of claim 12, further comprising a slot defining a recess in the housing, wherein the recess of the slot is capable of receiving a supporting element to support the light on the supporting element when the hook is in the stowed position.

16. The light of claim 12, wherein the heat sink includes a core portion that extends along the central axis and a plurality of arms extending radially outward from the core portion, wherein each of the plurality of arms define a sector and the sectors extend 360 degrees around the central axis.

17. The light of claim 16, wherein the plurality of arms each include fins that increase the surface area of the plurality of arms to enhance the cooling ability of the heat sink.

18. The light of claim 16, wherein the at least one light emitting diode is part of a plurality of light emitting diodes that are coupled to the plurality of arms.

19. The light of claim 17, further comprising a control unit disposed within the housing and a user interface in electrical communication with the control unit, wherein the user interface sends signals to the control unit to control the light assembly, wherein the control unit is capable of activating the light emitting diodes within a sector on a per sector basis in response to the signals from the user interface.

20. An area light comprising:

a first end that is configured to be supported on a support surface;

a second end that is opposite the first end, wherein light is emitted through the second end;

a central axis extending between the first end and the second end;

a housing that extends from a bottom surface toward the second end along the central axis;

a hook pivotably coupled to the bottom surface and moveable between a stored position, in which the hook is disposed between the bottom surface and the support surface, and an active position, in which the hook extends away from the housing;

a light assembly coupled to the housing and disposed between the housing and the second end;

a battery for supplying power to the light assembly;

a battery receptacle that receives the battery along a path that is perpendicular to the central axis; and a diffuser surrounding the light assembly and coupled to the housing, the diffuser tapers circumferentially inward toward the central axis along a direction from the housing to the second end, wherein the diffuser diffuses light being emitted from the light assembly:

(i) through the second end along a direction substantially parallel to the central axis, and (ii) 360 degrees radially outward relative to the central axis along a length of the central axis between the housing and the second end.

* * * * *